US007250743B2

(12) United States Patent
McVicar

(10) Patent No.: US 7,250,743 B2
(45) Date of Patent: Jul. 31, 2007

(54) VOLTAGE CONTROL SYSTEM

(75) Inventor: Randy McVicar, London (CA)

(73) Assignee: 748038 Ontario Inc. O/A Ecopower, London, Ontario (CA)

( * ) Notice: Subject to any disclaimer, the term of this patent is extended or adjusted under 35 U.S.C. 154(b) by 248 days.

(21) Appl. No.: 10/870,965

(22) Filed: Jun. 21, 2004

(65) Prior Publication Data

US 2005/0024027 A1 Feb. 3, 2005

Related U.S. Application Data

(60) Provisional application No. 60/479,843, filed on Jun. 20, 2003.

(51) Int. Cl.
*G05F 1/14* (2006.01)
*G05F 5/00* (2006.01)
*H05B 41/16* (2006.01)

(52) U.S. Cl. ..... 323/255; 323/301

(58) Field of Classification Search ..... 323/255, 323/258, 259, 262, 264, 301, 303, 355, 359, 323/361; 363/15–17, 98, 132; 336/15, 116, 336/145, 147, 148, 150, 182, 192, 200
See application file for complete search history.

(56) References Cited

U.S. PATENT DOCUMENTS

| | | | | |
|---|---|---|---|---|
| 2,180,193 | A | 11/1939 | Brand | |
| 4,431,948 | A | 2/1984 | Elder et al. | |
| 4,745,352 | A | 5/1988 | McGuire | |
| 4,791,348 | A | 12/1988 | McGuire et al. | |
| 5,189,601 | A * | 2/1993 | Sellers | 363/17 |
| 5,402,329 | A * | 3/1995 | Wittenbreder, Jr. | 363/16 |
| 5,528,110 | A | 6/1996 | Archdekin | |
| 5,811,939 | A | 9/1998 | Herniak | |
| 5,990,667 | A | 11/1999 | Degeneff et al. | |
| 6,078,146 | A | 6/2000 | Reverberi | |
| 6,272,027 | B1 * | 8/2001 | Fraidlin et al. | 363/26 |
| 6,353,547 | B1 * | 3/2002 | Jang et al. | 363/132 |
| 6,590,790 | B2 * | 7/2003 | Hosotani et al. | 363/21.16 |
| 2002/0097007 | A1 | 7/2002 | Koncz et al. | |
| 2002/0101192 | A1 | 8/2002 | Ann et al. | |

FOREIGN PATENT DOCUMENTS

| | | |
|---|---|---|
| DE | 195 43 249 A1 | 8/1996 |
| DE | 198 31 604 A1 | 2/2000 |
| EP | 0 746 184 A2 | 5/1996 |
| EP | 0 746 184 A3 | 5/1996 |

* cited by examiner

*Primary Examiner*—Matthew V. Nguyen
(74) *Attorney, Agent, or Firm*—Borden Ladner Gervais LLP

(57) ABSTRACT

The present invention is directed at circuit for controlling a voltage applied to an output voltage terminal from a first voltage level supplied by an input voltage terminal comprising a first switch and a second switch connected in series between said input voltage terminal and a common terminal; a transformer, having a primary side and a second side, connected with said first switch on the primary side and to said output terminal on the secondary side; wherein when said first switch is closed and said second switch open, said first voltage level is supplied to said output voltage terminal; and wherein when said first switch is open and said second switch is closed, a second voltage level is supplied to said output voltage terminal.

17 Claims, 11 Drawing Sheets

VOLTAGE CONTROL SYSTEM

CROSS REFERENCE TO RELATED APPLICATIONS

This application claims the benefit of U.S. Provisional Application No. 60/479,843, filed Jun. 20, 2003, which is incorporated herein by reference.

FIELD OF THE INVENTION

The present invention relates generally to supplying voltage to loads and more particularly, the present invention relates to apparatus for reducing the voltage supplied to loads.

BACKGROUND OF THE INVENTION

Lighting, and more specifically high intensity discharge (HID) lighting, makes up a large portion of the energy costs at many industrial, commercial, and public facilities. In many cases, full light output is not required during certain hours of the day or under specific operating conditions. Therefore, in order to achieve costs savings, it would be beneficial to control this lighting source in order to provide substantial energy cost reductions.

Currently, methods and apparatus exist to reduce the applied voltage to an HID load in a stepwise manner using solid state switching, and transformer tap switching. These methods usually have the drawback of being too costly and/or too complex.

One such prior art attempt is shown in FIG. 1 which comprises apparatus 10 for switching an output terminal 12 from a first voltage to a second voltage using an autotransformer 14, a first switch 16, a second switch 18, a third switch 20, and a resistive element 22. The resistive element 22 acts as a transitional buffer to facilitate the switching of the voltage at the output terminal 12 from an input voltage source 24 to the output of the autotransformer 14. For the system to provide full voltage, the first switch 16 is initially closed. In order to change from the first voltage (full voltage) to the second voltage, a transition is made whereby the third switch 20 is closed and the first switch 16 opened. The second switch 18 is then closed and the third switch 20 re-opened. As can be seen, the switches 16, 18 and 20 are located on the secondary side of the autotransformer 14 which requires the presence of the resistive element 22 to prevent damage to the switches 16, 18 and/or 20. This prior apparatus has several drawbacks such as the fact that the third switch 20 is required to facilitate the transition between the first and second voltages. Furthermore, the resistive element 22 is generally a large wattage restive element and is a required element of the apparatus 10. Also, the switches 16, 18 and 20 are in series with the output terminal 14 and must therefore be rated for the full load current being supplied by the input voltage source being controlled. Moreover, this method requires four switching operations (and therefore a more complex timing sequence) to transition from the first voltage level to the second voltage level.

It is, therefore, desirable to provide a novel apparatus and method for controlling voltage in lighting systems and more specifically in high intensity discharge lighting loads.

SUMMARY OF THE INVENTION

It is an object of the present invention to obviate or mitigate at least one disadvantage of previous voltage control systems. One advantage of various embodiments of the present invention is that the apparatus of the present invention requires only two switches to facilitate a transition of voltages from a first voltage to a second voltage. Another advantage is that there is no requirement for a resistive buffering element. Furthermore, the switches are not in series with the load and only carry a portion of the full load current (determined by the transformer ratio) and therefore result in a smaller circuit which is also less expensive than some prior art apparatus. Yet another advantage is that only two switching operations are required to transition from one voltage output to the other which reduces the complexity (and cost) of the control needed for the timing sequence. Moreover, the switches involved with the voltage control, are located on the primary side of the transformer.

The apparatus also allows for an energy savings to be appreciated. This invention provides a simple, reliable means of reducing the energy used by HID lighting loads at a reduced cost that should encourage the use of such energy saving devices. These fixtures are capable of operating at reduced input voltage after they have been started at full voltage for a specified period of time. This voltage transition must be done without causing significant current interruption that would extinguish the arc in the HID lamp and require it to be restarted at full voltage. This invention provides a method to efficiently accomplish such a voltage reduction to these lamps and other such un-interruptible loads In a first aspect, the present invention provides a circuit for controlling a voltage applied to an output voltage terminal from a first voltage level supplied by an input voltage terminal comprising a first switch and a second switch connected in series between said input voltage terminal and a common terminal; a transformer, having a primary side and a second side, connected with said first switch on the primary side and to said output terminal on the secondary side; wherein when said first switch is closed and said second switch open, said first voltage level is supplied to said output voltage terminal; and wherein when said first switch is open and said second switch is closed, a second voltage level is supplied to said output voltage terminal.

In another aspect, there is provided a circuit for controlling a voltage applied to an output voltage terminal from a first voltage level supplied by an input voltage terminal comprising a voltage control transformer having a primary side and a secondary side; a first, second and third switch connected in series between said input voltage terminal and said secondary side of said voltage control transformer; an output transformer having a primary and secondary side, connected in parallel on said primary side of said output transformer with said second switch and connected to said output terminal on said secondary side; and wherein when said first and third switches are closed and said second switch open, said first voltage level is supplied to said output voltage terminal; wherein when said first switch is open and said second and third switches are closed, a second voltage level is supplied to said output voltage terminal; and wherein when said first and second switches are closed and said third switch is open, a third voltage level is supplied to said output voltage terminal.

In yet a further aspect, there is provided circuit for controlling a voltage applied to an output voltage terminal from a first voltage level supplied by an input voltage terminal comprising a first switch and a second switch connected in series between said output voltage terminal and a common terminal; a transformer connected with said first switch and with said output terminal; wherein when said first switch is closed and said second switch open, said first voltage level is supplied to said output voltage terminal; and wherein when said first switch is open and said second switch is closed, a second voltage level is supplied to said output voltage terminal.

In yet another aspect, there is provided a circuit for controlling a voltage supplied to an output terminal from a first voltage level supplied by an input voltage terminal comprising a transformer having a primary side and a secondary side; and a first set of switches connected to taps on said primary side of said transformer; and a second set of switches connected to taps on said secondary side of said transformer; wherein said voltage is controlled by closing one of said first set of switches and one of said second set of switches.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a method and system for controlling voltage to a load, such as in a lighting system.

Figure 16:
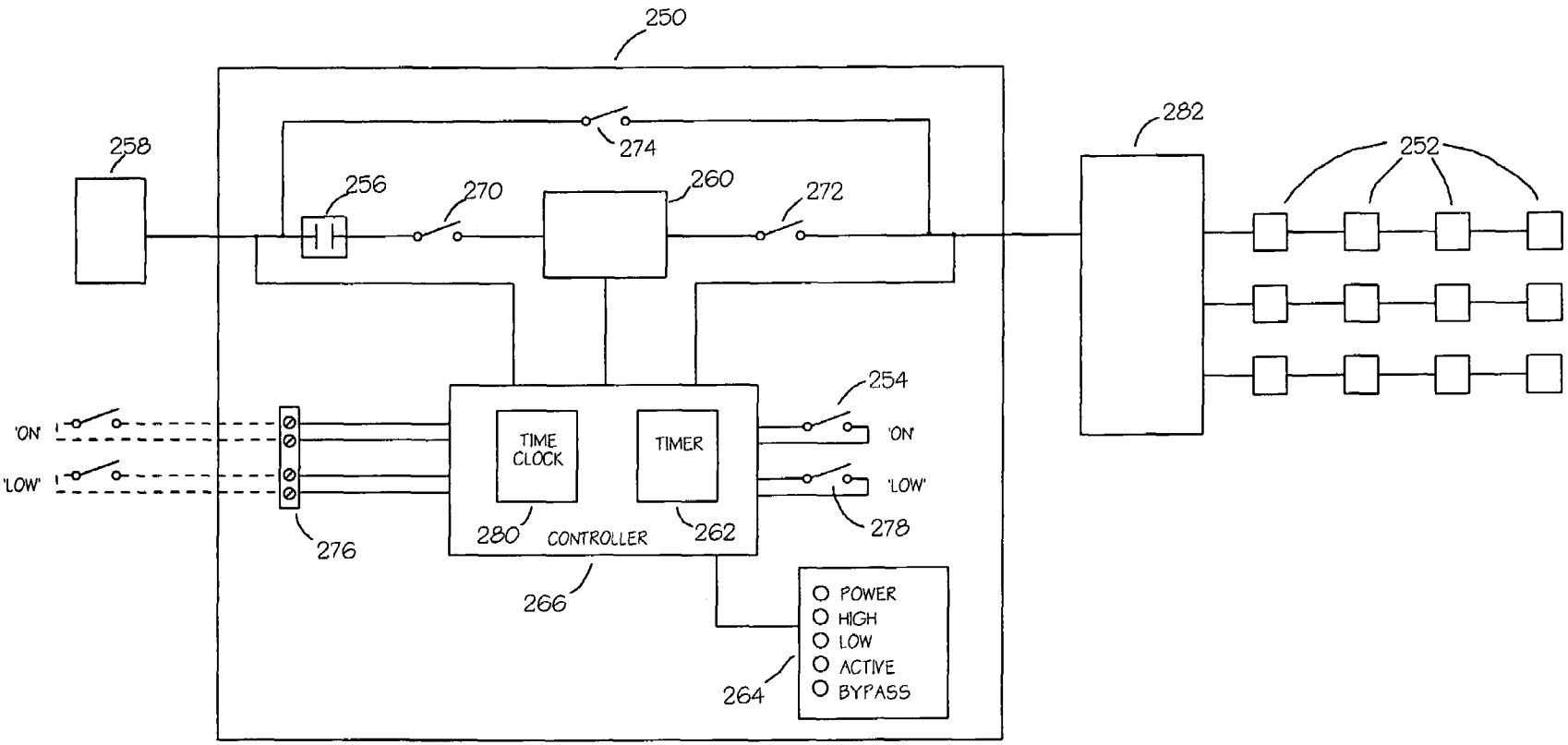
FIG. 16 is a schematic diagram of apparatus for controlling the voltage applied to a load.

Turning to FIG. 16, a schematic diagram of apparatus for controlling the voltage supplied to a lighting load is shown. Although, the invention is preferably directed at providing a circuit for controlling a lighting load, it will be understood that this voltage control circuitry may also be implemented in motors.

The apparatus 250 is connected to at least one lighting load 252. Generally, the apparatus 250 is located in front of an individual lighting circuit or in front of a common connection point of a multitude of lighting circuits, i.e. a lighting panel 282.

When a user activates the lighting load, by turning on a lighting switch 254, a main contactor 256 is closed in order to apply a voltage 258 to a circuit 260 for controlling the voltage (which will be described in more detail below). It will be understood that the lighting switch may also be an internal time-clock 280 or a remote terminal strip 276. After the main contactor 256 is closed, the input voltage 258 is applied directly to the circuit 260. In this embodiment, full voltage may be supplied to the lighting load 252 via a bypass switch 274 or the voltage may be transmitted to the lighting load 252 via activation switches 270 and 272 and the circuit 260. This is selectable by the user. If the user selects to have a full voltage constantly supplied to the lighting load 252, then the lighting load 252 operates conventionally with no energy saving capability.

If the user selects to have the voltage 258 applied to the lighting load 252 to be reduced after a predetermined period of time, the voltage 258 is transmitted to the lighting load 252 via circuit 260, under the control of the controller circuit 266. Initially, the lighting load 252 operates at full voltage. However, after a timer 262 has elapsed i.e. a predetermined time period has passed, the controller verifies that the user has selected the power saving mode by checking one of a low switch 278, the time clock 280 or the timer 262. If the power saving mode has been selected, a signal is transmitted from the timer 262 to the circuit 260 in order to open and close various switches in the circuit 260 as will be described below.

The apparatus may also include a set of LED's 264 which represent the level of voltage being supplied to the lighting load 252 as well as the status of the main contactor 256, switches 270, 272, and the time clock 280, in order to visually inform the user.

Figure 1:
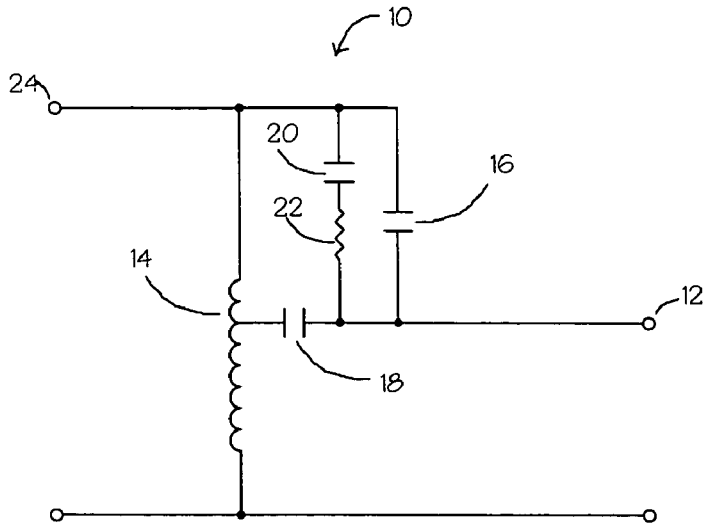
FIG. 1 (PRIOR ART)
FIG. 1 is a circuit drawing of an example of Prior Art.
Figure 2:
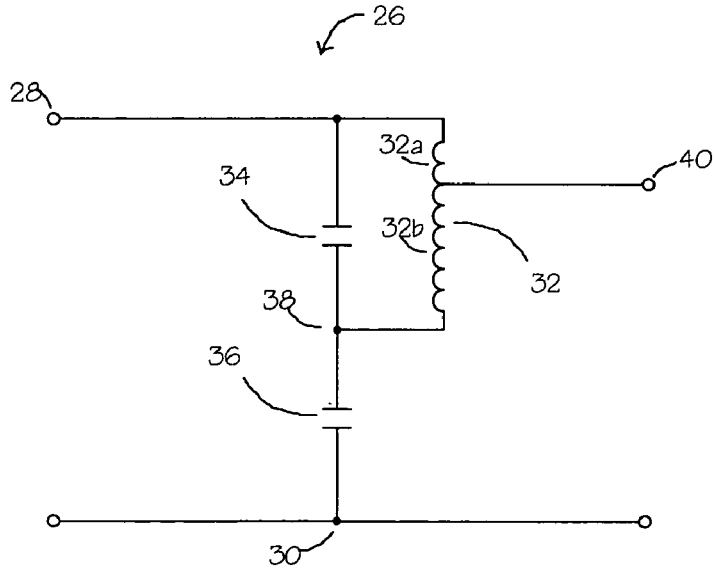
FIG. 2 is a circuit drawing of a first embodiment of a circuit for controlling voltage applied to a load.

Referring to FIG. 2, a first embodiment of a circuit 26 is shown in accordance with the present invention.

In this embodiment, the circuit is a bi-level configuration providing means to supply the full voltage and to provide a second reduced voltage to the output terminal. The circuit 26 comprises an input terminal 28 and a common terminal 30 with the voltage 258 being connected therebetween, an autotransformer 32, a first switch 34 and a second switch 36, configured so that the two switches 34 and 36 are connected in series across the input terminal and the common terminal on the primary side of the transformer 32. In this embodiment, the primary side of the transformer 32 is connected between the input terminal 28 and a common junction point 38 between the two switches 34 and 36 while the secondary tap of the transformer 32 is connected to an output terminal 40. Upon sensing the voltage at the input terminal 28 when the user has turned the switch 254 on, the application of voltage to the circuit 26 i.e. by activating a circuit to turn on the light, the first switch 34 is closed so that no voltage is applied across the primary of the transformer 32, resulting in full voltage being transmitted from the input terminal 28 to the output terminal 40 to allow initiation of the lighting load 252, preferably an HID lighting load. After a predetermined time period of continued use, such as approximately 20 to 30 minutes, the circuit 26 receives a signal from the timer 262 and the first switch 34 is opened. After the first switch is opened 34, following a short time interval of preferably less than 1 second, the second switch 36 is closed therefore applying a full voltage across the primary of the transformer 32, causing the output voltage to be reduced by the ratio of the transformer i.e the position of the output terminal 40 on the secondary side of the transformer. During this short transition period, the output terminal 40 maintains a path of electrical connection to the input terminal 28 through a portion of the transformer windings 32*a*. In this manner, the voltage to the lighting load is reduced and the lamp remains lit. Switching from low to high is done in reverse order by first opening second switch 36, waiting the same short time interval, then closing first switch 34. This generally occurs if the user elects to provide full voltage to the lighting load. In one embodiment, this may be achieved by use of internal High/Low switch 278, the time clock 274, or input to the control terminal strip 276. If power is lost to the circuit during the countdown stage, the timer is generally re-initialized when the power returns so that the output switches to full voltage for the 20 to 30 minutes time interval once again. The timing sequence for starting and transitioning to reduced output voltage may be implemented by using a programmed PLC, discreet timing devices, or any circuit so designed to provide the required functionality. Output selection is controlled automatically by internal timing devices or externally through control devices such as manual switches, timers, switches, photocells, motion sensors, etc.

The primary to secondary ratio of the transformer 32 (location of the output terminal's connection to the transformer) determines the maximum voltage reduction and the resulting reduction in current drawn from the voltage source connected to the input terminal 28 to the output terminal 40. For example, if a voltage source of 120VAC is applied across the input terminals, 28 and 30, a 100 ampere constant current load is connected between the output terminal 40 and the common terminal 30, and the transformer 32 has a turns ratio (32*a*+32*b*:32*a*) of preferably, 5:1. For the purposes of simple calculations, transformer efficiency and loss figures as well as transient inrush energizing currents are disregarded. The characteristics of the circuit are as that the maximum voltage reduction of the system is 20% of input voltage, which results in the two possible outputs of 120VAC (with first switch 34 closed) or 96VAC (with second switch 36 closed), the current flow through transformer section 32*a* is 80 amperes and through section 32*b* is 20 amperes regardless of which switch is closed (34 or 36). When either switch 34 or 36 is conducting current to the transformer 32, the maximum steady state current through the switch is 20 amperes, and when the first switch 34 is closed, 100 amperes is drawn from input terminal 28 and when the second switch 36 is closed, 80 amperes is drawn from input terminal 28.

Therefore, in this example, the voltage reduction percentage is equal to the turns ratio of the transformer section 32*a* that remains in series with the output terminal, to the transformer primary (32*a*+32*b*) and is equal to the current draw reduction percentage achieved while second switch 36 is closed and to the percentage of load current that first and second switches 34 and 36 are required to conduct during system operation. The capability of this circuit to allow switches (34 and 36) rated to conduct 20 amperes (in this example) to effectively change the input voltage to a load several times larger in current draw (five times magnitude in this example) and is one of the advantages of the present invention.

Figure 3:
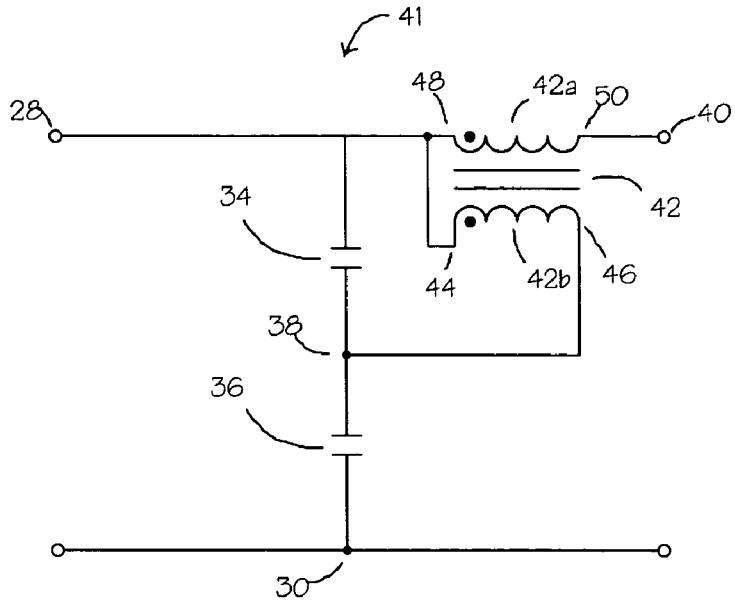
FIG. 3 is a circuit drawing of a second embodiment with an isolation transformer.
Figure 4:
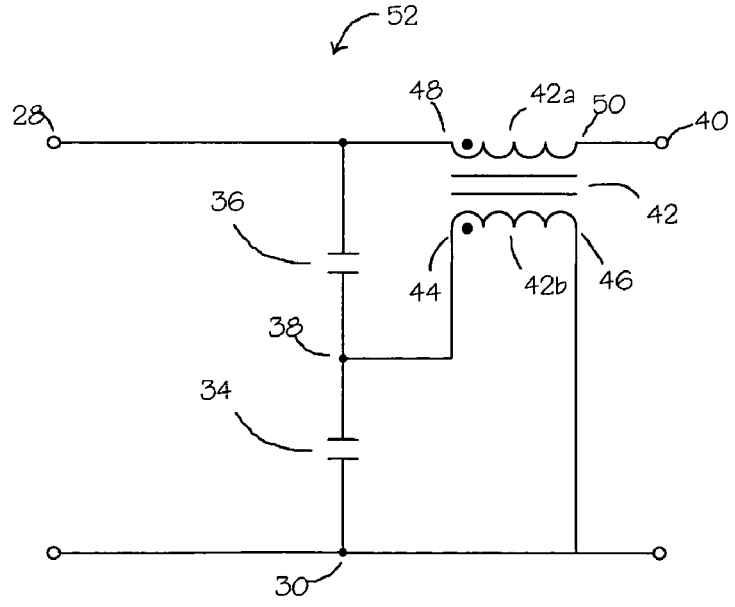
FIG. 4 is a circuit drawing of a third embodiment.

FIGS. 3 and 4 show examples of how an isolation transformer 42 could be used instead of an autotransformer to perform the same voltage reduction task.

FIG. 3 shows the circuit 260 as circuit 41 with a high voltage winding, seen as an isolation transformer 42, connected in such way that a primary side 42*b* of the transformer 42 is across the first switch 34, with one of the transformer's primary terminal 44 connected to the input terminal 24 and the other transformer primary terminal 46 connected to the common junction point 38 of the two switches 34 and 36. A secondary side 42*b* of the transformer 42 is connected in series with the output terminal 40 in such a way that one secondary transformer terminal 48 is connected to the input terminal 28 and the other secondary transformer terminal 50 is connected to output terminal 40. It is essential that the secondary side 42*b* of the transformer 42 is connected in such a way that the voltage produced across said secondary terminal is 180° out of phase with the voltage applied to the input terminal 28 in order to oppose this voltage, resulting in a reduced voltage at the output terminal 40 which is equivalent to the voltage at the input terminal 28 minus the voltage potential produced across the secondary side 42*a* of the transformer 42.

Operation of this embodiment is similar to the operation of the embodiment described above with reference to FIG. 2. This circuit 41 generally has the same characteristics in reference to voltage reduction percentage, current reduction percentage, and switch operating current percentage if used with the same numerical values in the example associated with FIG. 2, i.e. the ratio of 32*a*:32*b* in FIG. 2 equals the ratio of 42*a*:42*b* in FIG. 3.

FIG. 4 shows yet another embodiment of the circuit 260, seen as circuit 52, using an isolation transformer 42. In this circuit 52, the secondary 42*a* of the transformer 42 is connected in an identical fashion to the input terminal and the output terminal as described in FIG. 3. The primary 42*b* of the transformer 42 however is connected such that the primary transformer terminal 44 is connected to the common switch junction point 38 and the other primary transformer terminal 46 is connected to the common input/output terminal 30. In order to perform the same tasks as described above with respect to FIGS. 2 and 3, the positions of switches 34 and 36 are transposed in this embodiment.

Figure 5:
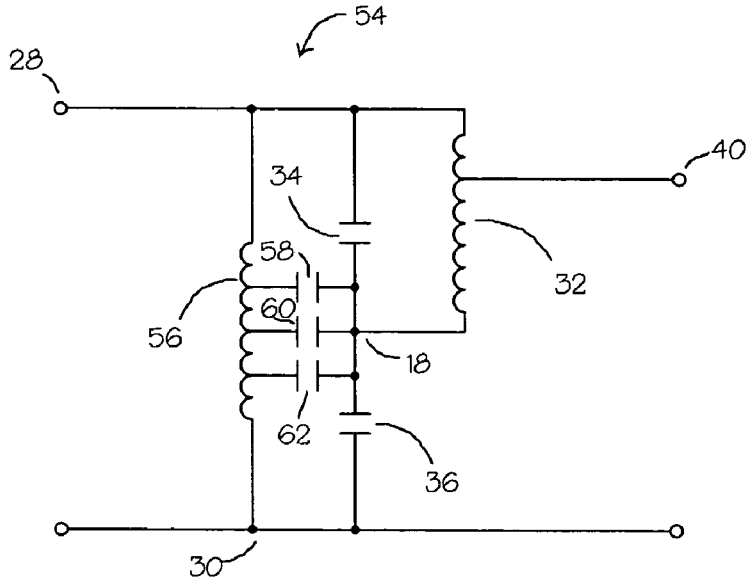
FIG. 5 is a circuit drawing of a fourth embodiment of a circuit for controlling voltage applied to a load.

FIG. 5 shows yet another embodiment of the circuit 260, seen as circuit 54, for voltage control comprising a circuit modification to allow more than one extra output voltage level to be selected. This circuit 54 may be seen as a multi-level embodiment. The addition of a second transformer 56, seen as an autotransformer in the figure, allows for additional output levels to be obtained. In order to obtain the output levels, several additional output voltage taps are coupled to the common switch junction point 38 through additional tap switches 58, 60, and 62. Levels are selected via the internal timer 262, internal user selection switches 278 or signals to the control terminal strip 276. In the preferred embodiment, the transformer 56 is preferably an autotransformer due to efficiency, however, the transformer may be substituted with a standard transformer with multiple secondary taps. Transition from one output to another is accomplished similarly to that of the circuit shown in FIG. 2 with the added flexibility that following the expiry of the predetermined time period, with first switch 34 closed and the output terminal 40 at full voltage, the circuit 54 may transition to one of four other levels by first opening switch 34 then closing one of the switches 58, 60, 62, or 36. The total voltage reduction percentage of this circuit is determined by multiplying the turns ratio of transformer 32 (32*a*+32*b*:32*a*) by the ratio of the voltage potential across the primary of transformer 32 to the source voltage at terminal 28. As an example, and with the same assumption as stated in the previous example, if the source voltage at terminal 28 is 120VAC and the tap switch 62 is closed and is connected to a tap on the second transformer 56 that has a voltage potential of 30 VAC with reference to the common terminal 30, and transformer 32 has a turns ratio of 5:1 (20%); then the total voltage reduction percentage of the circuit is (120VAC−30VAC)÷120VAC×20%=15%.

Likewise, if one of the switches 58 and another switch 60 were connected to tap voltages of 90VAC and 60VAC respectively, then total voltage reduction percentages of the circuit are 5% and 10% respectively when these switches are closed independently.

For many lamp types, especially those that are HID, all the output reduction levels (or steps) need not be made in the transition from full output to maximum output reduction. However, those lamp types that are sensitive to drastic voltage changes (high pressure sodium, in particular) may require sequential voltage reduction steps. To this end, the timing circuitry of the system has the capability of sequentially changing the output voltage from any level to a lower level, with sufficient time delays at each step to accommodate these lamp requirements. This is accomplished through the use of a timer that holds the output voltage at each level for a predetermined time before continuing to the next lower level in the sequence. Such sequential steps are not needed when transitioning from a lower to a higher voltage output.

Figure 6:
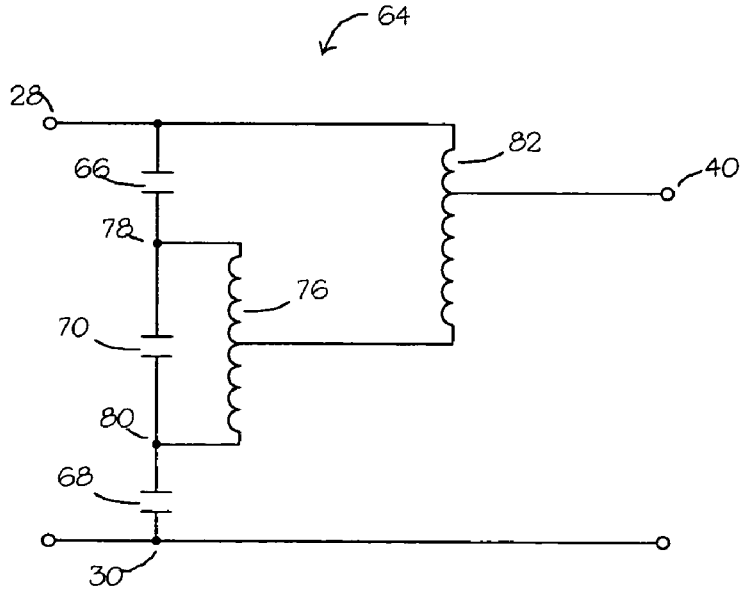
FIG. 6 is a circuit drawing of a fifth embodiment of a circuit for controlling voltage applied to a load.

FIG. 6 shows an alternate embodiment of circuit 260, seen as circuit 64, that is capable of providing up to three output voltage levels. In this circuit, a first, second, and third switch 66, 70, and 68, are connected in series between the input voltage terminal 28 and the common terminal 30. The circuit 64 also includes a first transformer 82.

A second transformer, seen as an autotransformer, 76 is connected in such a way that its primary is connected between a common junction point 78 of the first switch 66 and the second switch 70, and a common junction point 80 of the second switch 70 and third switch 68. The primary of the transformer 82 is connected between an output terminal of autotransformer 76 and the input voltage terminal 28. The output of the transformer 82 is connected to the voltage output terminal 40. With this circuit arrangement, the full voltage is supplied to the lighting load 252 by closing the first switch 66 and the second switch 70 with the third switch open, an intermediate output level is obtained by closing the first switch 66 and the third switch 68, and a maximum output reduction is obtained by closing the second switch 70 and the third switch 68. For each level selected, two switches remain closed while the third remains open. Transitions are performed by opening one of the two closed switches, then closing the remaining switch. For example, transitioning from the full output level with the first switch 66 and the second switch 70 closed, to the intermediate output level with the first switch 66 and the third switch 68 closed, would be performed by first opening the second switch 70 then closing the third switch 68. Transition from full output to maximum reduction is best accomplished by stepping through the intermediate level. This sequential stepping ensures that there is always a path of electrical conduction from the output terminal 40 to either the input terminal 28 or the common terminal 30, through transformer 76 as well as transformer 82, which preferably reduces output distortion compared to transitioning directly. In addition, the switching sequence required for this circuit 64 may be slightly more difficult than other embodiments to implement since each output level requires two closed switches.

Figure 7:
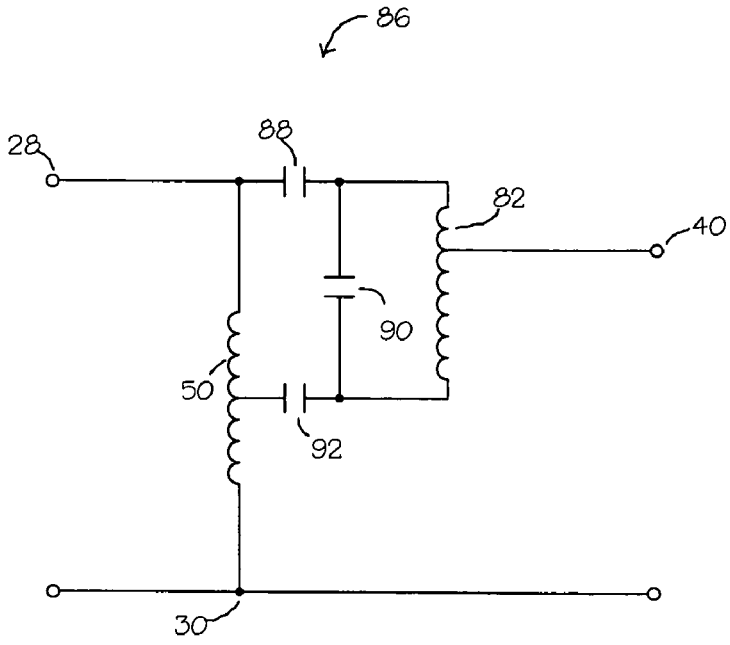
FIG. 7 is a circuit drawing of a sixth embodiment of a circuit for controlling voltage applied to a load.

FIG. 7 provides a circuit 86, representing circuit 260, which allows both ends of the output transformer 82 to be switched to other voltage levels. This type of circuit operates in a similar fashion to that shown in FIG. 6 and previously described, in that it includes a first switch 88, a second switch 90, and a third switch 92, connected in series with output levels being selected by the closure of any two of the switches. The drawback of this type of circuit is that the first switch 88 and the third switch 92 as well as transformer 94, must be rated for the full output load current, rather than a percentage of the load current based on voltage reduction ratio as in previous circuit configurations. As with the previous embodiments, the circuit 86 includes the input terminal 28 and the output terminal 40.

Figure 8:
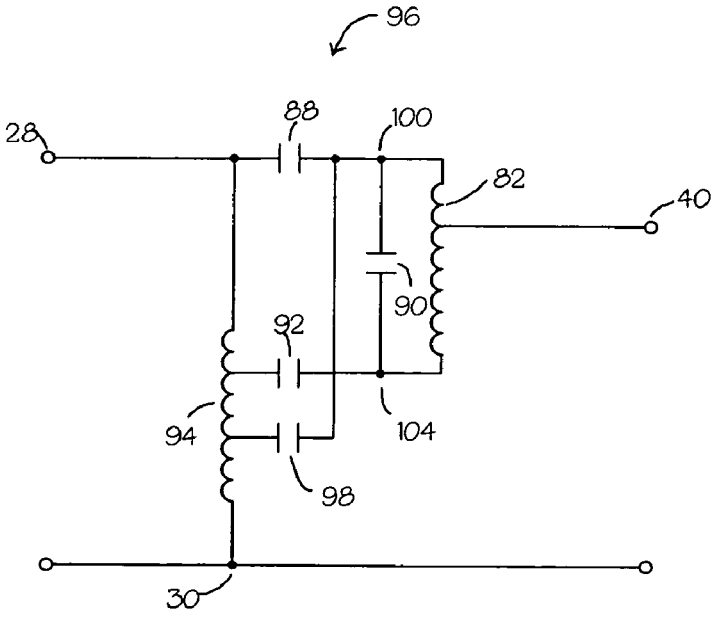
FIG. 8 is a circuit drawing of a seventh embodiment of a circuit for controlling voltage applied to a load.

In FIG. 8, a further circuit 96, representing circuit 260, for controlling voltage comprises a fourth switch 98 which has been added so that a second output tap on the transformer 94 may be coupled to a common connection point 100 of the first switch 88 and the second switch 90. The addition of the fourth switch 98 allows two additional levels to be selected. This increases the number of possible output voltage levels in relation to the number of switches required in that five voltage levels are possibly using only four switches. With this configuration, a voltage level is controlled by closing any of the following switch pairs: first switch 88 and third switch 92, first switch 88 and second switch 90, second switch 90 and third switch 92, second switch 90 and fourth switch 98, or fourth switch 98 and third switch 92. The only combination of switch closures not allowed is that of first switch 88 and fourth switch 98, which would cause a short across the transformer 94. Adding a further switch between the common terminal 30 and a common connection point 104 of second switch 90 and third switch 92, allows a possible eight voltage levels to be selected using five switches. As with the previous embodiments, the circuit 86 includes the input terminal 28 and the output terminal 40.

Figure 9:
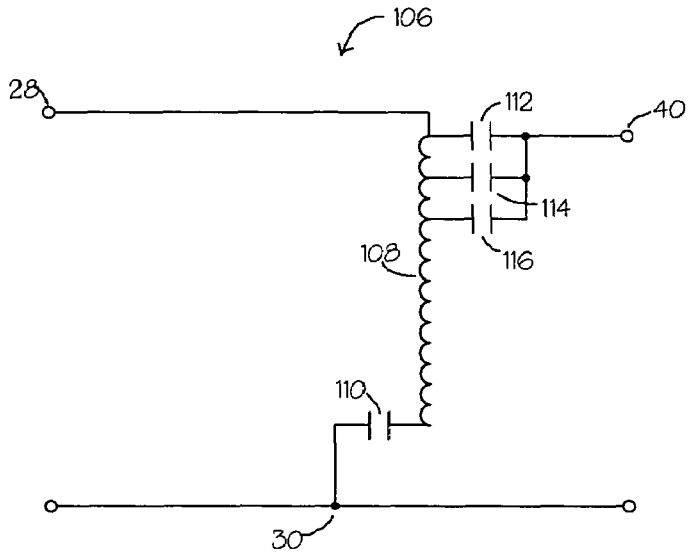
FIG. 9 is a circuit drawing of an eighth embodiment of a circuit for controlling voltage applied to a load.
Figure 10:
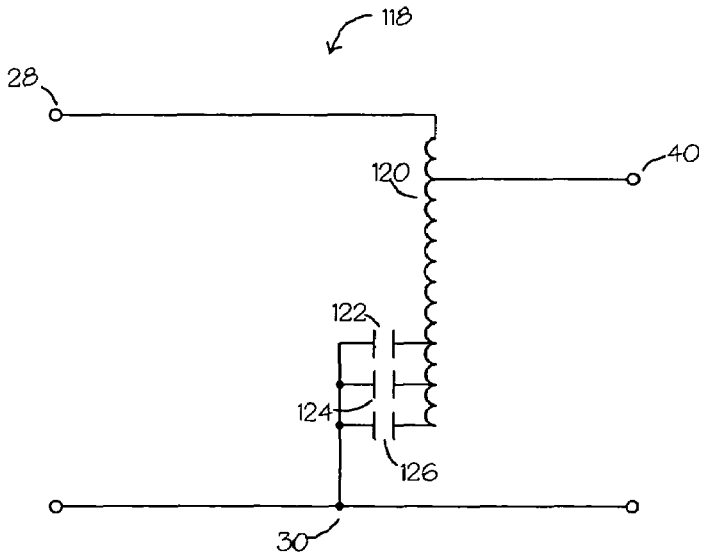
FIG. 10 is a circuit drawing of a ninth embodiment of a circuit for controlling voltage applied to a load.

FIGS. 9 and 10 display circuits for obtaining multiple voltage outputs without the requirement of a second transformer.

Referring to FIG. 9, the circuit 106 comprises a transformer, seen as multi-tap autotransformer, 108 having its primary connected in series with a first switch 110, between the input voltage source terminal 28 and the common input/output terminal 30. Output taps of the transformer 108 are each coupled to the output terminal 40 through a set of switches 112, 114, and 116. Each voltage level is controlled by closing the first switch 110 and one of the other switches 112, 114, or 116 coupled to the output terminal 40 resulting in three possible voltage level outputs. Since two of the three output switches 112, 114, and 116 need to be closed at the same time during transitions to avoid current interruption to the lighting load 252, the first switch 110 is opened to allow transformer 108 to operate as an inductance in series with output terminal 40. Transition between voltage levels are achieved by first opening the first switch 110, closing the desired output switch (112, 114, or 116), opening the pre-transition output switch (112, 114, or 116) and then closing switch 110. In this embodiment, full load rated switches are required for switches 112, 114, and 116.

FIG. 10 shows a circuit 118 comprising a high voltage winding, seen as an autotransformer, 120 having its primary connected between input voltage terminal 28 and the common terminal 30 through a first switch 122, a second switch 124, and a third switch 126, each coupled to a separate input tap on the transformer 120. The output tap of transformer 120 is connected to output terminal 40. Each voltage level is selected by closing one of the input switches 122, 124, or 126. Transitions between the voltage levels are performed by opening one of the switches 122, 124, or 126 and then closing one of the other switches. The transformer 120 in this circuit 118 should be rated for significantly more than the input source voltage 258 applied to the circuit at terminal 28 as full source voltage is applied across a portion of the transformer 120. For example, if the voltage applied to terminal 28 is 120VAC, and the first switch 122 is connected to a tap midway across the primary of transformer 120, the voltage rating of the transformer 120 must be at least 240VAC.

Figure 11:
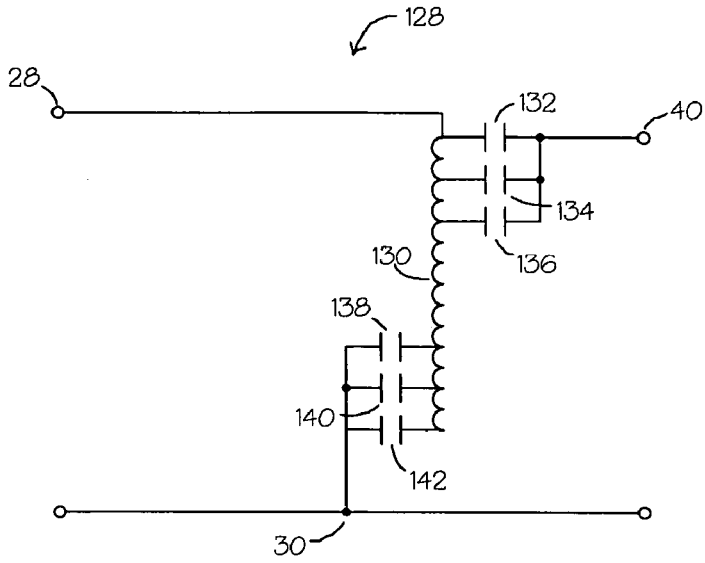
FIG. 11 is a circuit drawing of a tenth embodiment of a circuit for controlling voltage applied to a load.

Turning to FIG. 11, yet another embodiment of a circuit 128 for controlling voltage to a lighting load is shown. The circuit 128 is a combination of the circuits of FIGS. 9 and 10. The primary of a transformer, seen as an autotransformer, 130 is connected between the input voltage terminal 28 and the common terminal 30 while the output tap of the transformer 130 is connected to the output terminal 40.

A set of switches 132, 134 and 136 are connected between the output taps of the transformer 130 and the output terminal 40 while a second set of switches 138, 140 and 142 is connected to input taps of the transformer 130. Each of the switches may be closed or opened (as described above) to control the voltage level being supplied from the input voltage terminal 28 to the output voltage terminal 40.

Figure 12:
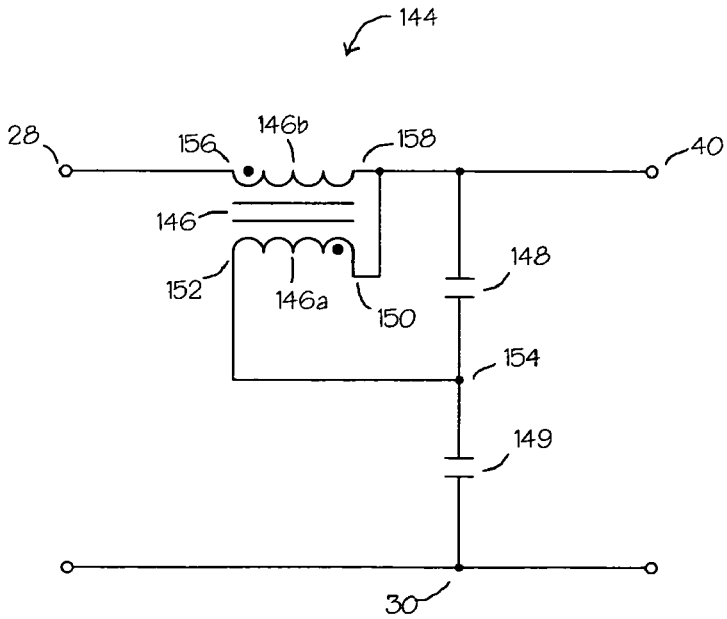
FIG. 12 is a circuit drawing of an eleventh embodiment of a circuit for controlling voltage applied to a load.

Turning to FIG. 12, yet another circuit 144 for controlling voltage supplied to the lighting load is shown. The circuit 144 includes the input terminal 28, the common terminal 30 and the output terminal 40 along with a first switch 148 and a second switch 149.

A transformer, seen as isolation transformer, 146 is connected in such way that a primary side 146*a* of the transformer 146 is across a first switch 148, with one of the transformer's primary terminals 150 connected to the output terminal 40 and the transformer's other primary terminal 152 connected to the common junction point 154 of the two switches 148 and 149. A secondary side 146*b* of the transformer 146 is connected in such a way that one secondary transformer terminal 156 is connected to the input terminal 28 and the other secondary transformer terminal 158 is connected to output terminal 40.

It is essential that the secondary side 146*b* of the transformer 146 is connected in such a way that the voltage produced across said secondary is 180° out of phase with the voltage applied to the input terminal 28 in order to oppose this voltage, resulting in a reduced voltage at the output terminal 40 which is equivalent to the voltage at the input terminal 28 minus the voltage potential produced across the secondary side 146*b* of the transformer 146.

Figure 13:
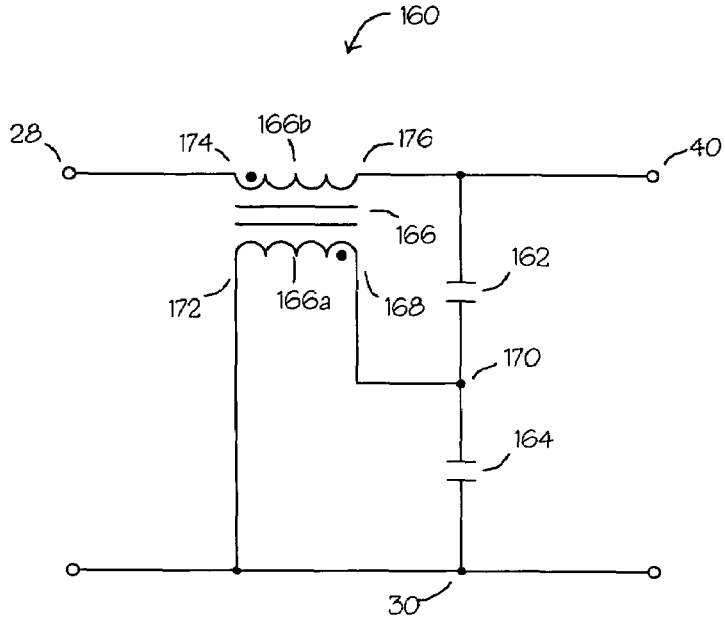
FIG. 13 is a circuit drawing of yet another embodiment of a circuit for controlling voltage applied to a load.

Turning to FIG. 13, yet a further embodiment of a circuit 160 for controlling voltage for a lighting load is shown. As with the embodiment shown in FIG. 12, the circuit 160 comprises the input terminal 28, the common terminal 30 and the output terminal 40. The circuit further includes a pair of switches 162 and 164 connected in series between the output terminal 40 and the common terminal 30.

The circuit 160 further comprises a transformer, seen as an isolation transformer, 166 which has a primary side 166*a* connected across the switch 164, with one of the transformer's primary terminals 168 connected to a common junction point 170 between the two switches 162 and 164 and the transformers other primary terminal 172 connected to the common terminal 30. A secondary side 166*b* of the transformer 166 is connected in such a way that one secondary transformer terminal 174 is connected to the input terminal 28 and the other secondary transformer terminal 176 is connected to the output terminal 40.

Figure 14:
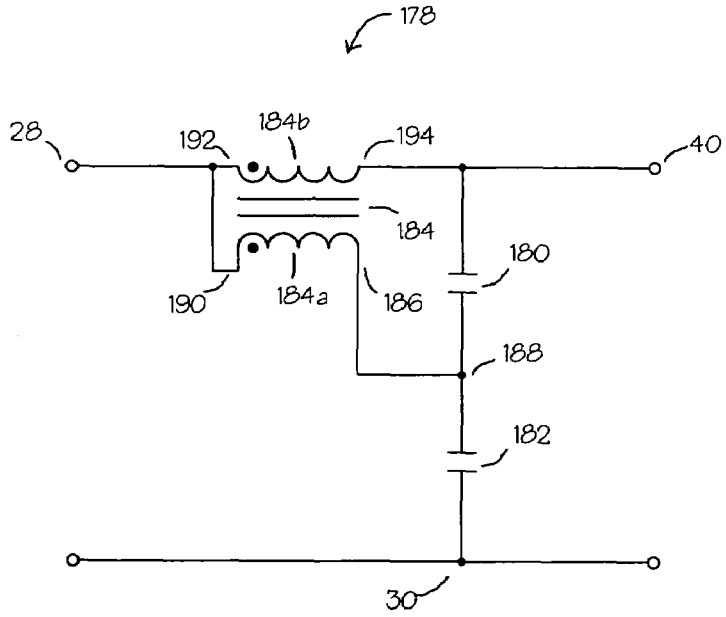
FIG. 14 is a circuit drawing of a further embodiment of a circuit for controlling voltage applied to a load.

Turning to FIG. 14, yet a further circuit 178 comprising a pair of switches 180 and 182 and an isolation transformer 184 along with the input terminal 28, the output terminal 40 and the common terminal 30 is shown.

The circuit 178 further comprises the isolation transformer 184 which has a primary side 184*a* having one of its primary terminals 186 connected to a common junction point 188 between the two switches 180 and 182 and the transformer's other primary terminal 190 connected to the input terminal 28. A secondary side 184*b* of the transformer 184 is connected in such a way that one secondary transformer terminal 192 is connected to the input terminal 28 and the other secondary transformer terminal 194 is connected to the output terminal 40.

Figure 15:
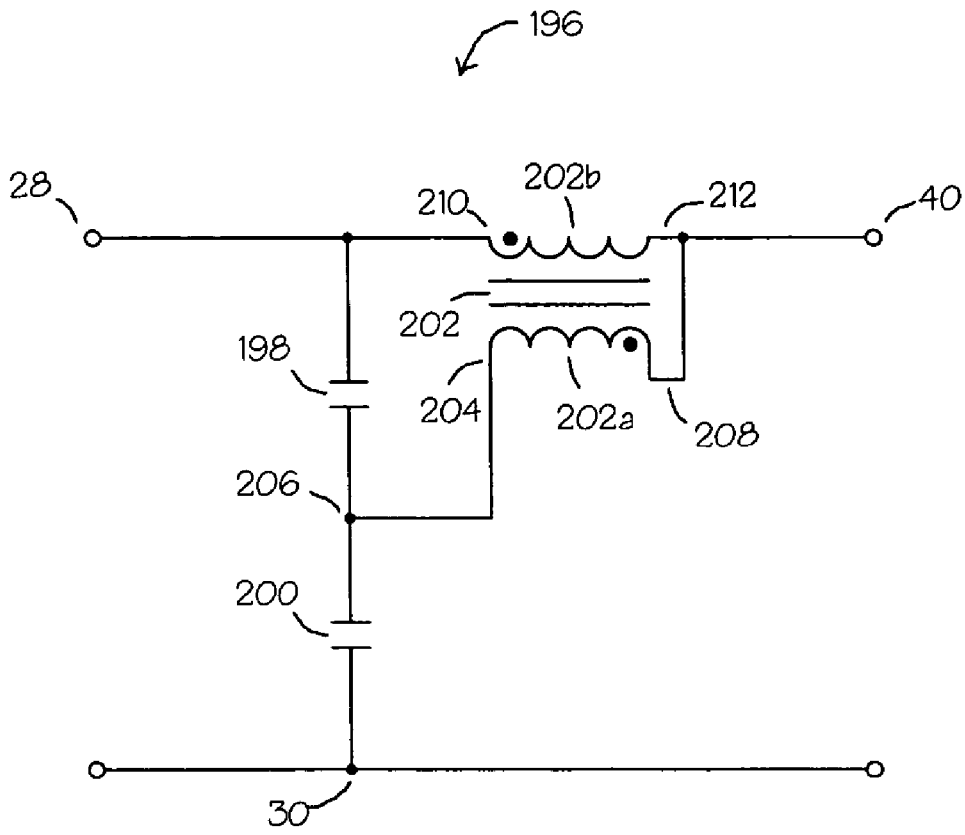
FIG. 15 is a circuit drawing of a yet another embodiment of a circuit for controlling voltage applied to a load.

Turning to FIG. 15, yet another circuit 196 for controlling voltage to a lighting load is shown. The circuit 196 comprises a pair of switches 198 and 200 and an isolation transformer 202 along with the input terminal 28, the output terminal 40 and the common terminal 30.

The circuit 196 further comprises the isolation transformer 202 which has a primary side 202*a* with one of the transformer's primary terminals 204 connected to a common junction point 206 between the two switches 198 and 200 and the transformer's other primary terminal 208 connected to the output terminal 40. A secondary side 202*b* of the transformer 202 is connected in such a way that one secondary transformer terminal 210 is connected to the input terminal 28 and the other secondary transformer terminal 212 is connected to the output terminal 40.

Figure 17:
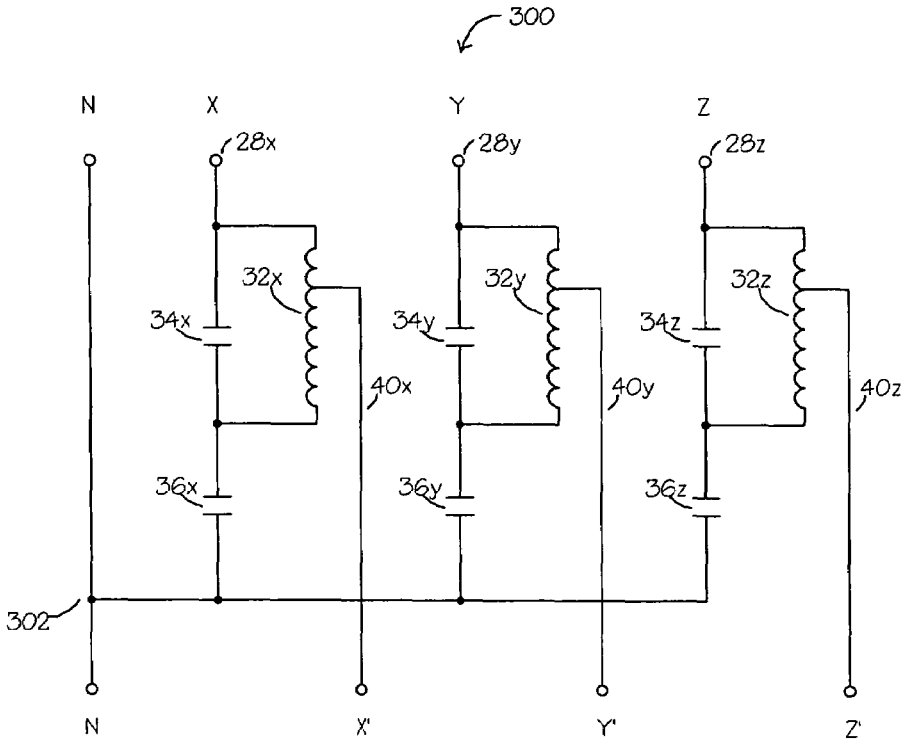
FIG. 17 is a circuit drawing of a 3-phase embodiment of a circuit for controlling voltage applied to a load using a common neutral connection.

Turning to FIG. 17, a circuit 300 is shown, representing a three-phase embodiment of circuit 260. It can be seen that this embodiment includes three occurrences 26*x*, 26*y*, 26*z* of the circuit 26 as seen in FIG. 2 representing each phase of the input voltage and connected in a Wye configuration with all common terminals joined to form a single common connection 302. Operation of the circuit 300 is similar to circuit 26 and follows the same sequence of switch operations to change the voltage at the output terminals 40*x*, 40*y* and 40*z*. It will be understood by one skilled in the art that the three single-phase transformers may be substituted for one three-phase transformer in this and all multiphase embodiments.

Figure 18:
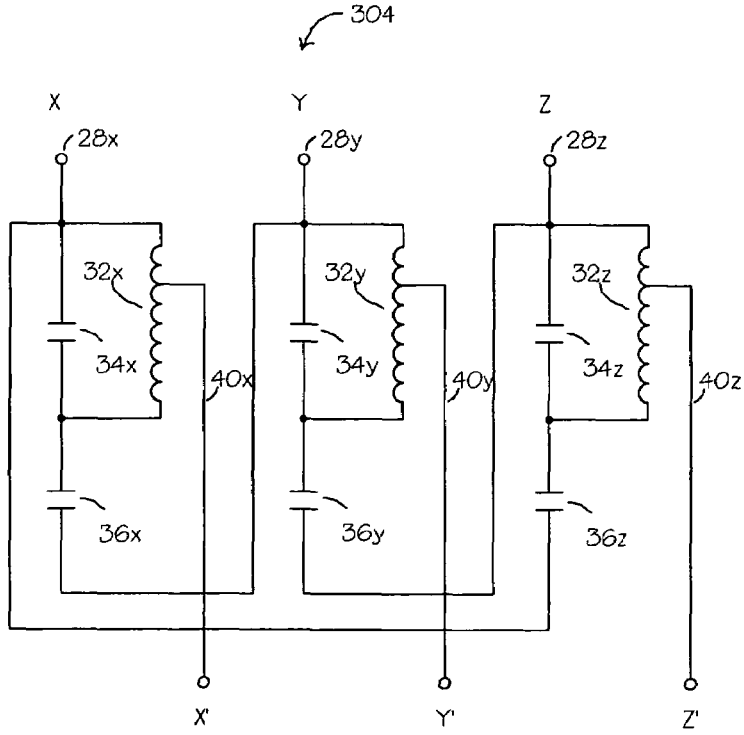
FIG. 18 is a circuit drawing of a 3-phase embodiment of a circuit for controlling voltage applied to a load without using a common neutral connection.

FIG. 18 shows a circuit 304 representing another three-phase embodiment of circuit 260 which does not require a common input/output connection. In this embodiment there are three occurrences 26*x*, 26*y*, 26*z* of the circuit 26 (for each phase of input voltage) which are connected in a Delta configuration with each second switch 36*x*, 36*y*, 36*z*, connected to the input voltage 28 of the next phase. For instance the second switch 36*x* is connected to the input voltage 28*y* while the second switch 36*y* is connected to the input terminal 28*z*. The second switch 36*z* is connected to the input terminal 28*x*. Operation of this circuit is similar to that of FIG. 17 however, this embodiment results in a maximum 50% voltage reduction at the output terminals 40*x*, 40*y* and 40*z*.

Figure 19:
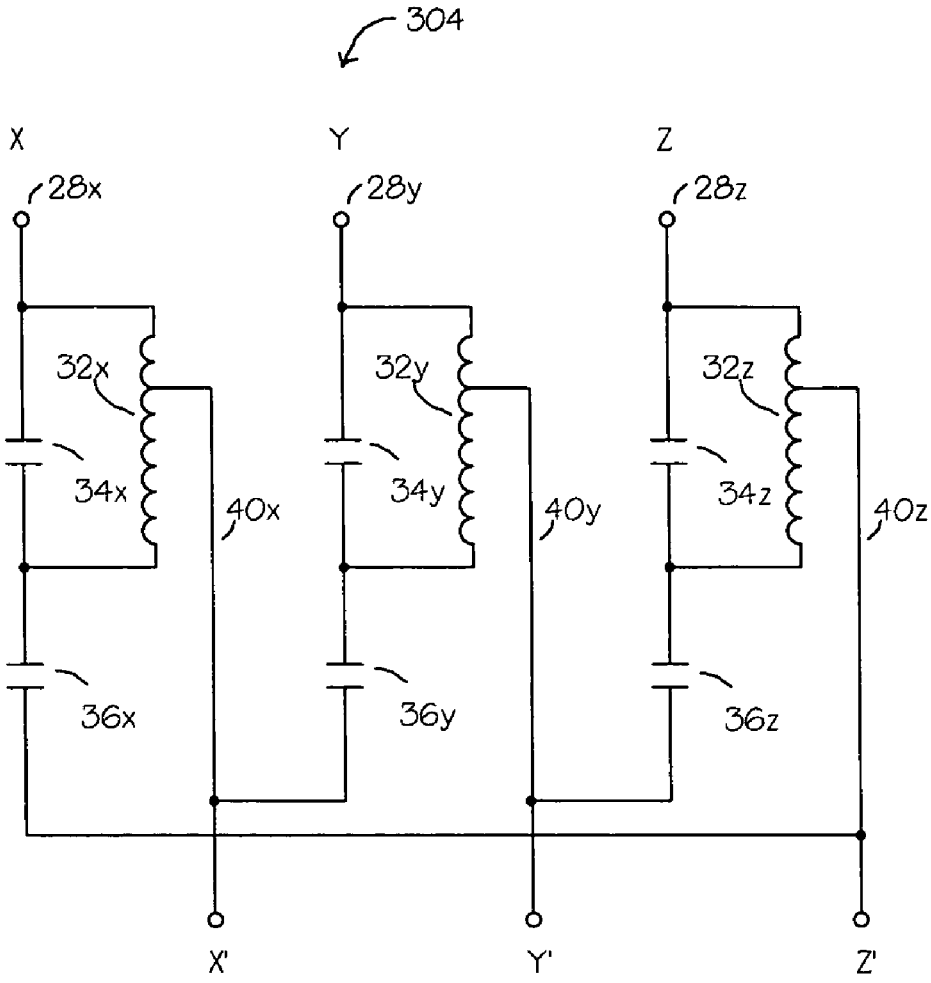
FIG. 19 is a circuit drawing of another 3-phase embodiment of a circuit for controlling voltage to a load without using a common neutral connection.

FIG. 19 shows a circuit 306 representing a three-phase embodiment of circuit 260. The circuit 306 provides the capability to reduce output voltage below 50%. As with FIGS. 17 and 18, the circuit 306 comprises three occurrences 26*x*, 26*y*, 26*y* of the circuit seen in FIG. 2 connected in a Delta configuration with each second switch 36*x*, 36*y*, 36*z*, of shown switch pair, connected to the output terminal 40 of the previous phase. For instance, the second switch 36*x* is connected to the output terminal 40*z* while the second switch 36*y* is connected to the output terminal 40*x* and the second switch 36*z* is connected to the output terminal 40*y*. It is understood that for lighting loads, phase sequence is typically not relevant. Therefore circuit connections in all Delta configurations may be reversed e.g. XYZ to XZY without departing from the scope of the shown circuits.

As will be understood, although the term switches has been used in describing the embodiments of the present invention, the switches may be a variety of devices such as contactors, relays, triacs, SCRs, solid-state relays, and any combinations thereof, or any means by which electrical connectivity may be controlled.

For the purposes of simplification, several assumptions have been made in the above descriptions and specifications of the invention. When discussing voltage and current values associated with the described circuit configurations, transformer losses ($I^2R$ losses, core losses, etc.) as well as short duration inrush currents where not taken into account. Assumptions of this type are normal to persons skilled in this field when describing electrical circuits of this nature.

Another advantage of the present invention is that components were established based upon cost, complexity, reliability and efficiency.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A circuit for controlling a voltage applied to an output voltage terminal from a first voltage level supplied by an input voltage terminal comprising:

a first switch and a second switch connected in series between said input voltage terminal and a common terminal;

a first transformer, having a primary side and a second side, connected with said first switch on the primary side and to said output terminal on the secondary side, said first switch connected in parallel with said transformer;

a second transformer connected between said input voltage terminal and said common terminal; and at least one tap switch connected between a secondary side of said second transformer and a common junction point between said first and second switches;

wherein when said first switch is closed and said second switch open, said first voltage level is supplied to said output voltage terminal;

wherein when said first switch is open and said second switch is closed, a second voltage level is supplied to said output voltage terminal; and wherein when said at least one tap switch further controls the voltage level being supplied to the output terminal high voltage winding.

2. The circuit of claim 1 wherein said second transformer is connected in parallel with said first and second switches.

3. A circuit for controlling a voltage applied to an output voltage terminal from a first voltage level supplied by an input voltage terminal comprising:

a first switch, a second switch and a third switch connected in series between said input voltage terminal and a common terminal;

a transformer, having a primary side and a second side, connected with said first switch on the primary side and to said output terminal on the secondary side; and a second transformer having a primary and a secondary side, connected in parallel with said third switch on said primary side and to said first transformer on said secondary side;

wherein when said first switch is closed and said second switch open, said first voltage level is supplied to said output voltage terminal;

wherein when said first switch is open and said second switch is closed, a second voltage level is supplied to said output voltage terminal; and wherein said third switch is closed when one of said first or second switch is open and wherein said third switch is opened when said first and second switches are closed to supply a third voltage level to said output.

4. A circuit for controlling a voltage applied to an output voltage terminal from a first voltage level supplied by an input voltage terminal comprising:

a voltage control transformer having a primary side and a secondary side;

a first, second and third switch connected in series between said input voltage terminal and said secondary side of said voltage control transformer;

an output transformer having a primary and secondary side, connected in parallel on said primary side of said output transformer with said second switch and connected to said output terminal on said secondary side; and wherein when said first and third switches are closed and said second switch open, said first voltage level is supplied to said output voltage terminal;

wherein when said first switch is open and said second and third switches are closed, a second voltage level is supplied to said output voltage terminal; and wherein when said first and second switches are closed and said third switch is open, a third voltage level is supplied to said output voltage terminal.

5. The circuit of claim 4 further comprising a fourth switch connected between a common junction point of said first and second switches and said secondary side of said voltage control transformer.

6. The circuit of claim 1 further comprising means for opening said first switch and for closing said second switch.

7. The circuit of claim 6 wherein said means for opening said first switch and closing said second switch is a controller.

8. The circuit of claim 7 further comprising:

means for determining when said first switch is to be closed; and communication means for transmitting a signal to said controller that said first switch is to be opened and said second switch closed.

9. The circuit of claim 7 wherein said controller may be selected from the group consisting of a programmed PLC, discreet timing devices, a microprocessor or a circuit board.

10. The circuit of claim 1 wherein said wherein said transformer is an auto transformer.

11. The circuit of claim 1 wherein said transformer is an isolation transformer.

12. The circuit of claim 3 further comprising means for opening said first switch and for closing said second switch.

13. The circuit of claim 3 wherein said wherein said transformer is an auto transformer.

14. The circuit of claim 3 wherein said transformer is an isolation transformer.

15. The circuit of claim 4 further comprising means for opening said first switch and for closing said second switch.

16. The circuit of claim 4 wherein said wherein said transformer is an auto transformer.

17. The circuit of claim 4 wherein said transformer is an isolation transformer.

* * * * *